United States Patent [19]

Thorpe

[11] Patent Number: 4,938,130

[45] Date of Patent: Jul. 3, 1990

[54] SCREEN PRINTING REGISTRATION DEVICE AND REGISTRATION METHOD

[76] Inventor: Robert C. Thorpe, 4439 Edwards La., Castro Valley, Calif. 94456

[21] Appl. No.: 362,618

[22] Filed: Jun. 7, 1989

[51] Int. Cl.[5] ..... B05C 17/08

[52] U.S. Cl. ..... 101/126; 101/123

[58] Field of Search ..... 101/114, 115, 123, 126, 101/127, 127.1, 128.1

[56] References Cited

U.S. PATENT DOCUMENTS

| | | | |
|---|---|---|---|
| 2,613,595 | 10/1952 | Weldon | 101/115 |
| 3,460,471 | 8/1969 | Green et al. | 101/115 |
| 3,731,623 | 5/1973 | Bubley et al. | 101/114 |
| 3,943,851 | 3/1976 | Inada et al. | 101/127.1 |
| 3,957,371 | 5/1976 | Rich | 355/74 |
| 4,023,524 | 5/1977 | Goldfarb et al. | 118/301 |
| 4,246,866 | 1/1981 | Hopings et al. | 101/126 |
| 4,409,924 | 10/1983 | Laverty et al. | 118/406 |
| 4,738,909 | 4/1988 | Jennings | 101/126 |
| 4,819,559 | 4/1989 | Szarka | 101/126 |

*Primary Examiner*—Edgar S. Burr
*Assistant Examiner*—Joseph R. Keating
*Attorney, Agent, or Firm*—Harris Zimmerman

[57] ABSTRACT

A specialized clamp fits on to a screen frame in a screen printing press of the type having a frame clamping arm that pivots towards a platen during printing operations. The clamp has a passage located to receive a conforming register pin that extends from the platen to assure that the screen registers precisely at a predetermined area of the platen including in instances where the frame guide structure to the press itself may exhibit significant play. The clamp is initially engaged on the pin but not tightened enabling the screen frame to be shifted to register with the desired area of the platen. The clamp and clamping arm are then tightened to provide for repeatability of the registration. The clamp may then be used, during set up, to seat a succession of adhesive coated register pins at corresponding locations on a series of additional platens.

9 Claims, 2 Drawing Sheets

SCREEN PRINTING REGISTRATION DEVICE AND REGISTRATION METHOD

TECHNICAL FIELD

This invention relates to screen printing apparatus and methods for screen printing designs, artwork, information or the like and more particularly to apparatus and methods for assuring that a screen frame registers precisely with a predetermined area of a platen that supports material which is to receive the image.

BACKGROUND OF THE INVENTION

In screen printing operations, a porous screen formed of any of various fabrics such as silk, polyester or of metal mesh is fastened to a screen frame. A negative of the image which is to be printed may be painted on the screen or a stencil like reproduction of the image may be adhered to the screen. The material which is to receive the image is disposed on a platen or work table and the screen frame is impressed against the material. A squeegee is then used to force paste-like ink of the desired color through the unpainted areas of the screen or through the open areas of the stencil. The frame is then retracted leaving the desired image on the imprinted material. Additional impressions on the same area of the material can be made with additional screens when a multi-colored image is desired.

Screen printing is used extensively for printing works of art designs, or information on materials which may be of any of a variety of types such as posters, signs, clothing or glass or metal objects among other examples. Screen printing is advantageous for many purposes as the required equipment can be less costly than other forms of printing apparatus and set-up procedures can be relatively simple.

In most operations, it is desirable that the screen frame register precisely with a predetermined area of the platen which supports the material to be imprinted. This enables the printed image to be placed at exactly the same location on successive pieces of material. Precise registration is particularly important when a series of screen frames must be impressed on the same piece of material to provide a multi-color image or for other reasons. An even minute displacement of one color relative to other colors in the image can significantly detract from image quality.

Screen printing presses designed for high volume production typically have a screen frame clamping assembly or a platen assembly which is pivoted to bring the frame and platen together during a printing operation and to separate the members for removal of the printed product and insertion of another piece of material. The frame supporting assembly is manufactured with close tolerances to inhibit misregistration but this objective is not always realized to the most desirable extent. Significant looseness or play in the frame clamping arm is often encountered and tends to become more pronounced after wear has occurred.

Registering mechanisms relying on fixed register pins on one of two mating members that enter fixed passages on the other member have heretofore been used in some types of printing apparatus but are not entirely satisfactory in the case of screen printing presses of the type described above. In addition to being complicated and costly, such pin registration mechanisms complicate set up procedures. The prior mechanisms would not, for example, enable shifting of the screen frame to register with a selected area of the platen at a time when a pin is already engaged in its mating passage which capability could facilitate initial set-up of a press. Prior pin registration mechanisms are also not readily adaptable to the use of screens of different sizes or configurations.

The present invention is directed to overcoming one or more of the problems discussed above.

SUMMARY OF THE INVENTION

In one aspect, the present invention provides apparatus for assuring that a screen frame of a screen printing press registers precisely at a predetermined area of a platen that supports material which is to receive a printed image. A clamp is adapted to be fitted on an edge of the frame and to engage with a register pin which extends from the platen, the clamp having a pin receiving passage located to receive the pin when the frame is traveled towards the platen. The clamp further includes means for securing the clamp to the frame at a selectable location on the frame.

In another aspect, the invention includes a register pin proportioned to enter the clamp member passage and means for fastening the pin to the platen at a selectable location on the platen.

In another aspect, the invention provides a pin registering clamp for fitting on to an edge of a screen frame of a screen printing press to assure that the frame registers precisely with a predetermined area of a platen that supports material which is to be imprinted. The clamp includes a clamp member having a flat inner arm for disposition against a portion of the surface of the screen frame that faces the platen, a substantially parallel outer arm for extension along the corresponding portion of the opposite surface of the screen frame in spaced apart relationship with the frame and an intermediate section for disposition adjacent the edge of the frame and which interconnects the inner and outer arms. The inner arm has a plurality of spaced apart register pin receiving passages located to be directed towards the platen as the screen frame is traveled towards the platen in the course of a printing operation and the outer arm has a threaded passage which extends through the arm. A threaded shaft is engaged in the passage of the outer arm and has an inner end adapted to bear against the frame and a handle at the outer end for facilitating manual turning of the shaft.

In still another aspect of the invention, a screen printing press has at least one platen for supporting material that is to be printed upon and at least one screen frame and screen frame clamping arm which can be pivoted to travel the frame towards the platen, the clamping arm having means for enabling selectable movement of the frame relative to the arm in a plane parallel to the platen followed by clamping of the frame to immobilize the frame relative to the clamping arm. A register pin is attached to an edge of the platen that is remote from the pivot axis of the frame clamping arm and extends towards an edge region of the screen frame. A selectably movable clamp is fitted on the edge region of the frame and has at least one register pin receiving passage located to be entered by the register pin as the frame approaches the platen. Clamping means selectively enable movement of the frame relative to the clamp while the clamp is engaged on the pin followed by immobilization of the clamp and frame relative to each other.

In a further aspect, the invention provides a method for assuring precise registration of a screen frame of a screen printing press with a predetermined area of a platen that supports material which is to be printed on, the method being applicable to presses in which the screen frame is gripped by a frame clamping arm which may be pivoted to travel the frame towards the platen. Steps in the method include attaching a register pin to an edge region of the platen, positioning a sample of the design which is to be printed on the platen, loosely inserting the screen frame into the frame clamping arm and pivoting the frame clamping arm to locate the screen frame against the sample and platen. A clamp is loosely fitted on to the screen frame and the register pin is fitted into the register pin receiving passage of the clamp to immobilize the clamp relative to the platen. The screen frame is then shifted as needed to bring the frame into register with the sample. The clamp and the screen frame clamping arm are then both tightened to immobilize the frame, clamping arm and clamp relative to each other. The clamping arm and frame are then pivoted away from the platen and the sample is removed. Thereafter, the pin is engaged in the pin receiving passage of the clamp as the frame approaches the platen during printing operations.

The invention provides a mechanically simple, economical and easily installed registration device which acts to assure that a screen frame seats precisely against the same area of a platen during successive printing operations including in presses where the primary frame guiding mechanism exhibits an undesirable amount of play or looseness. The invention can also simplify screen frame set up procedures as it enables shifting of a screen frame to register the frame with a selected area of the platen at a time when the register pin is already engaged in its pin receiver. The pin receiver clamp is simply tightened on the frame after the selected registration has been accomplished and thereby assures that an identical re-registration will occur during subsequent pivotings of the frame.

DETAILED DESCRIPTION OF THE PREFERRED EMBODIMENT

Figure 1:
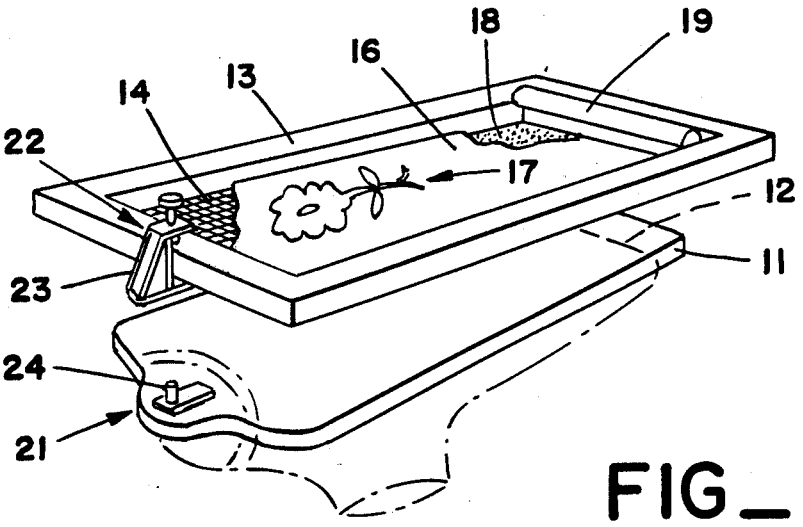
FIG. 1 is a perspective view of a registration device in accordance with the preferred embodiment of the invention shown installed on components of a screen printing press.

Referring initially to FIG. 1, basic components of a screen printing installation include one or more platens 11 or similar work tables on which the material 12 which is to receive an image is disposed and one or more screen frames 13 bounding a porous screen 14 formed of silk or other textiles or of metal mesh. A stencil like sheet 16 of fluid impervious material is disposed over the screen 14 and has open, fluid transmissive areas 17 which define the image that is to be printed. Printing is accomplished by placing frame 13 on platen 11 over the material 12 and forcing paste-like thixotropic ink 18 through the open areas 17 with a squeegee 19 or similar tool.

The material 12 shown in FIG. 1 for purposes of example is a T-shirt on which a decorative design is to be imprinted and the depicted platen 11 has a rounded protruding region 21 at one end to accommodate to the neck of the T-shirt. It should be recognized that the invention is equally applicable to printing on other materials, paper or cardboard signs or posters or works of art being examples, and that the platen 11 need not necessarily have the particular configuration shown in FIG. 1.

The registration device 22 includes a pin receiving clamp 23 which is fittable onto an edge of frame 13 and which is initially movable relative to the frame and further includes a register pin 24 which extends from an edge region of platen 11, which components will hereinafter be further described. The registration device 22 assures that the frame 13 seats on platen 11 at precisely the same location during successive printing operations.

Figure 2:
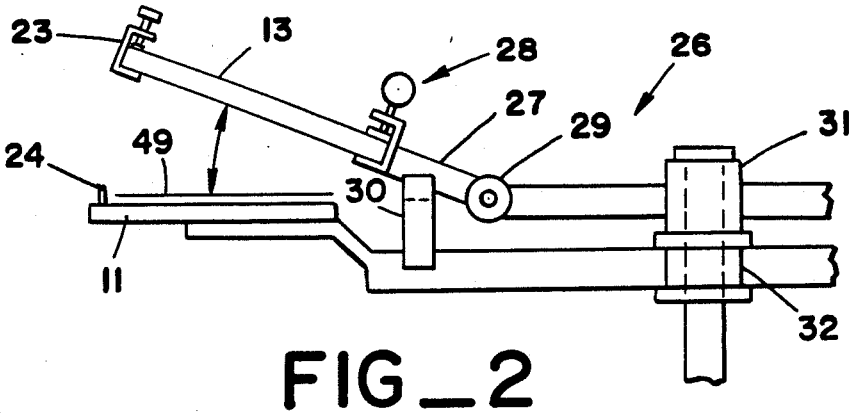
FIG. 2 is an elevation view of the registration device and press components with which the device directly interacts.

Screen printing in its simplest form can be accomplished manually with only the components described above although two of the registration devices 22 are needed to assure consistent registration of the frame 13 if it is unconnected to other mechanism. More commonly and particularly in the case of commercial operations, the frame 13 and platen 11 are components of a more complex installation. Referring now to FIG. 2, during a printing operation the platen 11 and screen frame 13 are coupled to press mechanism 26 which enables pivoting movement of the frame towards the platen and away from the platen.

Known press mechanisms 26 take variety of forms ranging from relatively simple constructions in which moving parts are manually manipulated to more complex semi-automatic or fully automatic motor driven systems. Such press mechanisms 26 have a pivotable screen frame clamping arm 27 with a clamping device 28 at the distal end in which the inner end of the screen frame 13 can be inserted and which can be tightened to immobilize the frame relative to the clamping arm. The clamping arm 27 is coupled to other components of press mechanism 26 through a pivot bearing 29 which enables the arm and frame 13 to be pivoted down towards platen 11 and material 12 to perform a printing operation.

The above described frame support structure is intended to cause the frame 13 to seat repeatedly against the same area of platen 11 but in practice a slight but significant variation can occur which is particularly pronounced at the outer end, or left end as viewed in FIG. 2, of the frame. This results from such causes as the cantilevered support of the frame, slight resiliency of components, play in joints such as pivot bearing 29, sideward movement of extension arms and slight flexibility of the frame itself. Such slight variations in frame registration can noticeably affect the quality of the printed image particularly if repeated impressions are made on the same piece of material 12 to imprint a variety of colors or for other purposes.

The repeated impressions can be made at a single work station by replacing the original screen 13 with another or, with reference jointlY to FIGS. Z and 3, the press mechanism 26 may have a plurality of platens 11 in a circular arrangement and a plurality of screen frame clamping arms 27 each supporting a separate screen frame. Each clamping arm pivot bearing 29 is connected to a rotatable hub 31 which enables the frames 13 to be jointly rotated to bring each frame into successive printing positions over successive ones of the platens 11. The clamping arms 27, when pivoted downward, engage in indexing slots 30 to angularly position the screens 13 relative to the platens 11 although as previously discussed this does not by itself assure precise, repeatable registration to the most desirable degree. In some press mechanisms 26, the platens 11 are connected to another rotatable hub 32 which adds further flexibility in the repositionings for successive operations.

Figure 3:
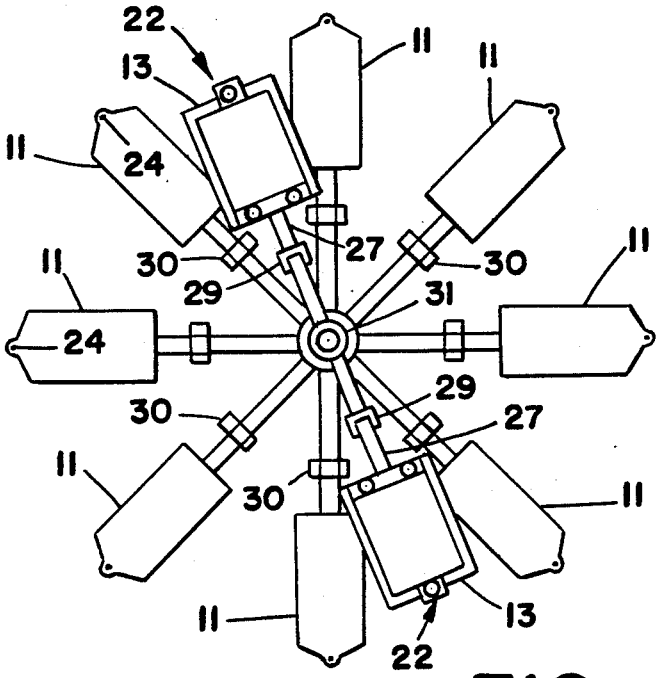
FIG 3 is a plan view illustrating usage of the registration device at a screen printing press having a plurality of platens and screen frames.

The registration device 22 of the present invention assures precise repeatability of registration either at single work stations where the original frame 13 is removed and replaced with others or at multiple platen, multiple frame press mechanisms of the kind depicted in FIG. 3.

Figure 5:
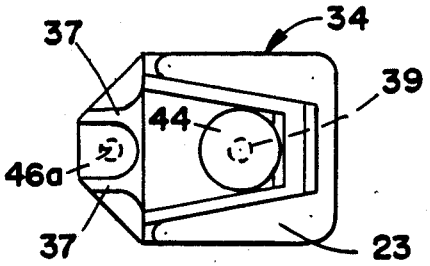
FIG. 5 is a top view of a clamp component of the registration device of the preceding figures.
Figure 4:
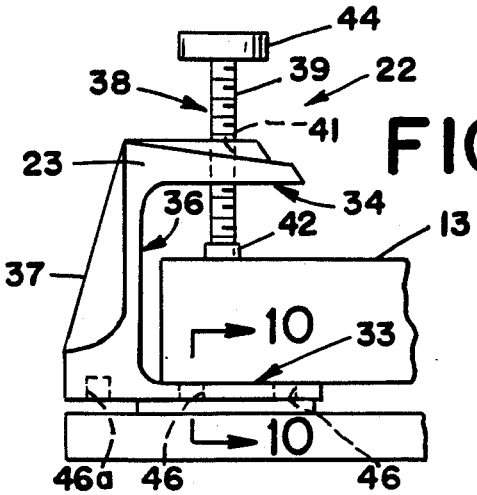
FIG. 4 is a side view of the registration device shown engaged on a screen frame and platen.

Referring to FIGS. 4 and 5 in conjunction, the pin receiver clamp 23 of registration device 22 has a thin flat inner arm 33 which fits against the surface of frame 13 that faces platen 11, a parallel outer arm 34 that extends along the corresponding portion of the opposite surface of the platen in spaced apart relationship to that surface, and an intermediate section 36 that interconnects corresponding ends of the inner and outer arms. Parallel triangular ribs 37 which extend along the outer face of intermediate section 36 in this example impart greater strength and rigidity to the clamp 23.

Clamping means 38 are present to provide for selectively immobilizing the clamp 23 on frame 13 and in this embodiment include a threaded shaft 39 which extends through and is engaged in a threaded passage 41 in the outer arm 34. A rotatable swivel pad 42 at the inner end of shaft 39 contacts and grips the frame 13 but does not transmit torsional forces when shaft 39 is turned. A handle 44 at the outer end of the shaft facilitates tightening and loosening of the clamp.

Figure 7:
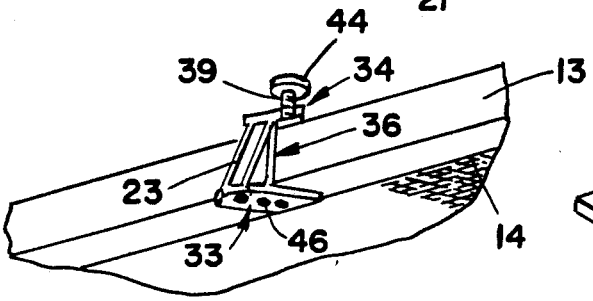
FIG. 7 is a perspective view of the clamp component shown engaged on a screen frame of a screen printing press.
Figure 6:
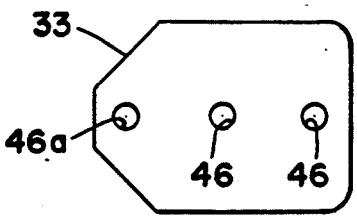
FIG. 6 is a view of the underside of the clamp component.

Referring jointly to FIGS. 6 and 7, the clamp 23 has at least one, and preferably more, pin receiving passages 46 located in the inner arm 33 and which are directed towards platen 11 when the clamp and frame 13 are positioned over the platen. Three such passages 46, spaced apart along the length of inner arm 33, are provided in the present embodiment. The presence of a plurality of the pin receiving passages 46 enables the clamp to engage a fixed pin that extends from platen 11 at any of a plurality of locations of the clamp along the platen and thus provides for accommodating to frames 13 that may be of different lengths.

Figure 8:
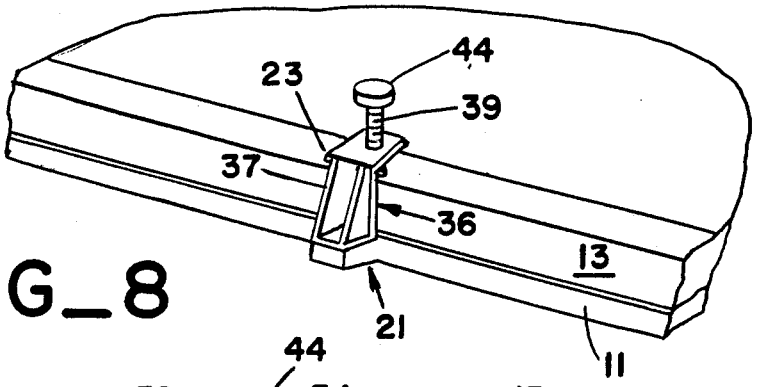
FIG. 8 is a perspective view of the engaged registation device shown installed on a screen frame and platen of a screen printing press.

Referring to FIG. 8, the outermost pin receiving passage 46*a* can be located outward from the intermediate section 36 of the clamp, between ribs 37. This extends the available locations for pin engagements where the clamp 23 is used with a platen 11 of the previously described kind that has a protruding region 21 at the outer end.

Figure 9:
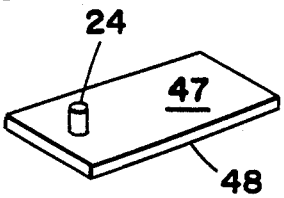
FIG. 9 is a perspective view of a pin tab component of the registration device of the preceding figures.
Figure 10:
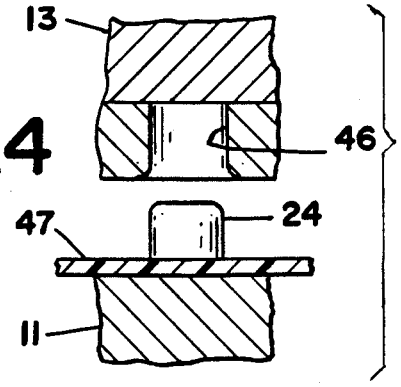
FIG. 10 is a partial section view essentially taken along line 10—10 of FIG. 4 although the clamp and pin components are shown slightly separated while such components are depicted in the engaged condition in FIG. 4.

Referring to FIGS. 9 and 10, the register pin 24 extends from a thin, flat, preferably plastic base or tab 47 which can be secured to the platen 11 by a layer 48 of adhesive on the underside of the tab. Pin tabs 47 of this general type have heretofore been used in other contexts, such as for engaging holes in sheets of film during preparation of stencils for screen printing or in other pre-press art preparation steps. Preferably, the pin 24 is located at or near an end of the tab 47. This enables the pin 24 to be positioned very close to the edge of a platen 11 where it is readily visible and where it is out of the way of work material that is to be printed upon.

Referring to FIG. 10 in particular, the pin receiving passages 46 have a diameter conforming to that of the pin 24 except at the extreme lower ends of the passages. The lower ends of the passages 46 are preferably flared or chamfered so that the entrance to each passage has a somewhat greater diameter than the rest of the passage. Preferably the upper end of the pin 24 also has a rounded or beveled configuration. This causes the passage 46 to self center onto the fixed pin 24 as the pin enters the passage and thereby causes the frame 13 to arrive precisely at the desired registration with platen 11.

Referring again to FIG. 1, it may be noted that the clamp 23 and pin tab 47 prevent the frame 13 and thus screen 14 from directly contacting the surface of platen 11. This slight spacing of the screen 14 from the platen 11 surface is customary practice in screen printing. It is partly compensated for by the thickness of the work material 12. The screen 14 distends slightly downward to contact material 12 during actual printing in response to the pressure exerted by squeegee 19.

In operation and in accordance with the method of the invention, pin 24 is secured to platen 11 in the manner previously described. Referring again to FIG. 2, a sample 49 of the design to be imprinted is temporarily placed on platen 11 and adjusted to the location where the image is to be printed. Frame 13, carrying the stencil like reproduction 16 of the image, is loosely fitted into the clamping device 28 of frame clamping arm 27 and the pin receiving clamp 23 is loosely fitted onto the opposite outer end of the frame. Arm 27 is lowered and clamp 23 is engaged on pin 24, the clamp being shifted relative to frame 13 if necessary to effect the engagement.

As neither clamp 23 nor clamping device 28 are tightened at this stage, frame 16 may be manually shifted as needed to bring the stencil reproduction 16 into precise register with the image sample 49 on the platen 11, the sample being visible through the openings in the stencil. Clamp 23 and clamping device 28 are then tightened, while the clamp remains engaged on pin 24, thereby immobilizing the clamp, frame 13 and arm 27 relative to each other.

Arm 27 is then pivoted upward and sample 49 is removed and replaced with work material that is to be imprinted. During the course of each subsequent printing operation, care is taken to assure that clamp 23 engages with pin 24. This assures that the frame 13 returns precisely to the original registration with platen 11 during each such imprinting.

While only a single clamp 23 and pin 24 are used at each frame 13 and platen 11 in the above described example of the invention, it can be advantageous to provide more in some cases. If the frame 13 is very wide, for example, one of a pair of the registration devices 22 may be situated at each side of the outer end of the frame 13.

Referring jointly to FIGS. 1 and 3, the invention further enables emplacement of a series of pins 24 at precisely corresponding locations on a series of platens 11 in a multiple platen press 26 of the kind previously described. Set up procedures are performed at a first of the platens 11, termed the master platen, in the manner described above. The screen frame 13 that was used to set up the master platen 11 is then pivoted up and turned about hub 31 to locate over the adjacent platen 11. The pin 24 of another pin tab 47, which has adhesive on the underside, is then engaged with the clamp 23 of that screen frame 13 and is temporarily held in place by the tip of the operator's finger as the screen frame is lowered towards the adjacent platen. The operator's finger is withdrawn as the frame 13 reaches the adjacent platen 11 and the adhesive coated tab 47 seats on and adheres to the adjacent platen. The process is repeated at each of the additional platens 11. Other screen frames 13 carried by hub 31 may then be set up at the master platen 11 in the manner previously described and the clamps 23 of the other screen frames will then register with and engage on the pins 24 of each of the platens.

While the invention has been described with respect to a particular specific embodiment for purposes of example, many variations and modifications are possible and it is not intended to limit the invention except as defined in the following claims.

I claim:

1. Register pin engaging apparatus for use with a screen printing press of the type having a platen for supporting material that is to receive a printed image and a screen frame for disposition over said platen and material during printing operations, said screen frame having edge members with undersurfaces that face said platen during printing operations and top surfaces that face away therefrom during printing operations, which apparatus assures that the screen frame registers precisely at a predetermined area of the platen, comprising:

a clamp adapted to be fitted on to an edge member of said screen frame and to engage with a register pin which extends upward from said platen, said clamp having a horizontally extending inner arm for disposition against said undersurface of said edge member and a spaced apart horizontally extending outer arm for disposition over said edge member top surface, said inner and outer arms having first ends that are vertically spaced apart a distance sufficient to enable entry of said edge member therebetween, said clamp further having a vertically extending intermediate section which interconnects said inner and outer arms at a location spaced from said first ends thereof, said clamp having at least one register pin receiving passage located to receive said pin when said frame is traveled towards said platen, said pin receiving passage being in said inner arm at a location which is directly above said platen when said clamp is fitted on to said edge member and said screen frame is over said platen in position for printing on said material, said clamp further having a vertically extending threaded passage located in said outer arm thereof, and clamping means for securing said clamp to said frame at a selectable location on said frame wherein said clamping means includes a vertically extending threaded shaft engaged in said threaded passage, said threaded shaft having a lower end adapted for exerting clamping pressure against said top surface of said edge member and having means for facilitating manual turning of said threaded shaft.

2. The apparatus of claim 1 further including a register pin proportioned to enter said pin receiving passage of said clamp and means for fastening said pin to said platen at a selectable location thereon.

3. The apparatus of claim 2 wherein said register pin has a base and wherein said means for selectively fastening said register pin to said platen includes a flat tab secured to the base of said pin and extending at right angles thereto and a quantity of adhesive for attaching said tab to said platen.

4. The apparatus of claim 3 wherein said base of said pin is secured to said tab at a location adjacent an edge of said tab.

5. The apparatus of claim 1 wherein said pin receiving passage has a lower end with a passage entrance thereat and has upper region situated above said entrance and wherein said passage has a diameter conforming to that of said pin except at the entrance to said passage, said passage entrance being flared to be of greater diameter than said upper region of said passage.

6. The apparatus of claim 1 wherein said clamp has a plurality of said pin receiving passages spaced apart along said inner arm, successive ones of said pin receiving passages being progressively further from said first end of said inner arm.

7. In combination with a screen printing press of the form having at least one platen which has a platen surface for supporting material that is to be printed upon, said screen printing press further having at least one screen frame which has edge members framing a porous screen or the like, said screen printing press further having a screen frame clamping arm which can be pivoted about a pivot axis to travel said screen frame towards said platen from a location spaced apart therefrom and which includes means for enabling selectable movement of said screen frame relative to said clamping arm in a plane parallel to said platen followed by clamping of said frame to immobilize said frame relative to said clamping arm, screen registering apparatus comprising:

a register pin attached to an edge region of said platen surface that is remote from the pivot axis of said frame clamping arm and which extends outward from said platen surface towards one of said edge members of said screen frame, a selectively movable clamp fitted on to said one of said edge members of said screen frame and having an inner arm which extends between said one edge member and said platen surface and a spaced apart parallel outer arm, said one edge member being received between said inner and outer arms, said clamp further having at least one register pin receiving passage in said inner arm thereof that is located to be entered by said register pin as said screen frame approaches said platen, said clamp having clamping means for selectively enabling movement of said frame relative to said clamp in each of two orthogonal directions while said clamp is engaged on said register pin followed by immobilization of said frame and clamp relative to each other.

8. In a method for assuring precise registration of a screen frame of a screen printing press with a predetermined area of a platen surface that supports material which is to be printed on, said screen frame being carried by a clamping arm which may be pivoted to travel said frame towards said platen, the steps comprising:

attaching a register pin to said platen surface at an edge region thereof, positioning a sample of the design which is to be printed on said platen surface, loosely inserting said screen frame into said frame clamping arm and pivoting said clamping arm to locate said screen frame against said sample and platen surface, loosely fitting a clamp on to an edge of said screen frame and fitting said register pin into a register pin receiving passage in said clamp to immobilize said clamp relative to said platen surface, shifting said screen frame as needed to bring said frame into register with said sample, tightening said clamp and said clamping arm to immobilize said frame and said clamping arm and said clamp relative to each other, pivoting said clamping arm and frame away from said platen surface and removing said sample therefrom, and engaging said pin in said pin receiving passage of said clamp as said frame approaches said platen surface during each of a plurality of subsequent printing operations.

9. The method of claim 8 wherein said screen printing press has a plurality of platens and wherein said screen frame and clamping arm are movable to successive ones of said platens, wherein additional register pins are installed at corresponding locations on each successive one of said platens by the steps of:

positioning said screen frame and clamping arm over said successive one of said platens in spaced apart relationship therewith, inserting an additional register pin into said pin receiving passage of said clamp and providing an adhesive on said pin, pivoting said clamping arm and frame towards said successive one of said platens while holding said additional register pin in engagement with said clamp until said pin contacts said successive one of said platens and adheres thereto.

* * * * *